US010062979B2

(12) United States Patent
Adams et al.

(10) Patent No.: US 10,062,979 B2
(45) Date of Patent: Aug. 28, 2018

(54) TERMINAL BLOCK MARKER

(71) Applicant: Panduit Corp., Tinley Park, IL (US)

(72) Inventors: Michael Scott Adams, Cumming, GA (US); Zachary Scott Ganster, Canton, GA (US); Jennifer Lynn Schwert, Atlanta, GA (US)

(73) Assignee: Panduit Corp., Tinley Park, IL (US)

( * ) Notice: Subject to any disclaimer, the term of this patent is extended or adjusted under 35 U.S.C. 154(b) by 1 day.

(21) Appl. No.: 15/235,408

(22) Filed: Aug. 12, 2016

(65) Prior Publication Data

US 2017/0054231 A1 Feb. 23, 2017

Related U.S. Application Data

(60) Provisional application No. 62/208,157, filed on Aug. 21, 2015.

(51) Int. Cl.
*H01R 3/00* (2006.01)
*H01R 9/24* (2006.01)
(Continued)

(52) U.S. Cl.
CPC ..... *H01R 9/2683* (2013.01); *B31D 1/02* (2013.01); *G09F 3/06* (2013.01); *H01R 9/2475* (2013.01); *H01R 13/465* (2013.01)

(58) Field of Classification Search
CPC . G09F 19/00; G09F 11/00; G09F 5/00; G09F 9/00; G09F 3/00; G09F 7/18;
(Continued)

(56) References Cited

U.S. PATENT DOCUMENTS 1,856,375 A * 5/1932 Cohen ..... G09F 5/042 206/487
1,996,664 A 4/1935 Walker
(Continued)

FOREIGN PATENT DOCUMENTS

DE 1857546 U 8/1962
DE 11714047 B 5/1964
(Continued)

OTHER PUBLICATIONS

Wago® Innovative Connections, WMB Multi Marking System data sheet, 2 pgs., Mar. 21, 2012.
(Continued)

*Primary Examiner* — Michael A Lyons
*Assistant Examiner* — Milagros Jeancharles
(74) *Attorney, Agent, or Firm* — Christopher S. Clancy; James H. Williams; Aimee E. McVady

(57) ABSTRACT

A terminal block marker designed to identify a terminal block. The terminal block marker includes a rigid base and a flexible film insert. The rigid base includes a top with a first arm having a first inwardly extending projection and a second arm having a second inwardly extending projection. The rigid base also includes a bottom with legs extending in a direction opposite the arms to hold the terminal block marker in the terminal block. A flexible film insert with identification markings is installed on the rigid base. The flexible film insert is positioned under a first projection of the first arm and rotated downward until the flexible film insert snaps under the second projection of the second arm. The first and second projections retain the flexible film insert on the rigid base to form the terminal block marker.

5 Claims, 8 Drawing Sheets

(51) Int. Cl.

| | |
|---|---|
| ***H01R 9/22*** | (2006.01) |
| ***H01R 9/26*** | (2006.01) |
| ***B31D 1/02*** | (2006.01) |
| ***G09F 3/06*** | (2006.01) |
| ***H01R 13/46*** | (2006.01) |

(58) Field of Classification Search

CPC ..... H01R 9/24; H01R 9/2683; H01R 9/2475; H01R 13/465; B41J 3/46; B41J 3/4075; B31D 1/02

USPC ..... 40/107, 611, 611.02–611.08, 642.02, 40/661.03, 661–669, 585, 593, 597, 643, 40/651; 206/486, 487, 820; 439/488–491

See application file for complete search history.

(56) References Cited

U.S. PATENT DOCUMENTS 2,151,536 A * 3/1939 Sperry ..... G03B 21/326 242/584.1
2,172,528 A * 9/1939 Auer ..... G03B 42/047 101/380
2,636,297 A * 4/1953 Johnson ..... G09F 3/10 156/253
2,746,189 A 5/1956 Bass
2,848,703 A * 8/1958 Foote ..... H01R 9/2475 439/491
2,951,301 A * 9/1960 Slavsky ..... G09F 3/203 40/653
3,067,403 A * 12/1962 Kulka ..... H01R 9/2475 439/491
3,164,250 A * 1/1965 Paxton ..... B65B 51/043 206/343
3,337,977 A 8/1967 Sobesky
3,524,271 A 8/1970 Buske
3,556,291 A * 1/1971 Sebring ..... G09D 3/04 206/486
3,650,055 A * 3/1972 Bult, III ..... G09F 7/00 40/506
3,885,334 A * 5/1975 Banks ..... G09F 3/10 40/638
3,921,798 A 11/1975 Dean et al.
3,942,620 A 3/1976 Dillinger et al.
3,953,933 A * 5/1976 Goldstein ..... H02G 3/12 174/66
4,214,024 A * 7/1980 Jacobson ..... B31D 1/021 156/253
4,253,629 A 3/1981 Wilmes
4,258,487 A * 3/1981 Hohorst ..... G09F 3/06 40/299.01
4,539,766 A 9/1985 Fast
4,622,770 A * 11/1986 Howard ..... G09F 11/00 40/488
4,637,676 A 1/1987 Simonsen et al.
4,649,658 A 3/1987 Sarton et al.
4,866,868 A * 9/1989 Kass ..... G09F 3/201 40/651
5,080,607 A 1/1992 Cristescu
5,161,981 A * 11/1992 Deak ..... H01R 12/62 439/491
5,201,451 A * 4/1993 Desai ..... H01L 23/4985 228/44.7
5,212,899 A * 5/1993 Fandreyer ..... G09F 3/20 174/66
5,331,758 A * 7/1994 Romick ..... G09F 3/204 40/661
5,338,224 A 8/1994 Blanke et al.
5,419,715 A * 5/1995 Laveissiere ..... H01R 9/2683 439/491
5,432,673 A * 7/1995 Ogami ..... G06F 1/1616 361/679.32
5,579,907 A 12/1996 Kedski
5,613,874 A * 3/1997 Orlando ..... H01R 13/465 40/607.13
5,620,335 A * 4/1997 Siemon ..... H01R 13/46 439/447
5,638,624 A 6/1997 Cornu
5,700,986 A 12/1997 Rürup et al.
5,741,153 A 4/1998 Schwer
5,819,419 A * 10/1998 Schmidt ..... B43M 7/002 30/289
5,862,616 A * 1/1999 Peroni ..... G09F 7/02 40/607.15
5,896,826 A 4/1999 Winer
5,933,994 A * 8/1999 Misaresh ..... G09F 23/06 40/649
6,146,213 A 11/2000 Yoon
6,234,830 B1 * 5/2001 Ensz ..... H01R 9/2475 439/49
6,298,526 B1 10/2001 Baumdicker et al.
6,700,782 B1 3/2004 Bopp et al.
6,718,674 B2 * 4/2004 Caveney ..... G09F 3/20 40/611.09
6,729,902 B2 * 5/2004 Martich ..... H01R 9/2683 439/488
6,793,524 B2 * 9/2004 Clark ..... H01R 13/518 439/536
6,836,402 B1 * 12/2004 Huang ..... H01R 13/465 174/50
6,908,334 B2 * 6/2005 Huang ..... H01R 13/465 439/491
D516,633 S * 3/2006 Kosir ..... D20/44
7,353,629 B2 * 4/2008 Caveney ..... G09F 3/20 40/299.01
7,559,791 B1 * 7/2009 Kao ..... H01R 13/465 439/491
7,740,282 B2 6/2010 McNutt et al.
7,963,056 B1 6/2011 Mangone, Jr.
8,480,441 B2 * 7/2013 Wu ..... H01R 4/4836 439/491
8,488,134 B2 7/2013 Reibke
8,517,758 B2 * 8/2013 Pizzi ..... H01R 9/2683 439/491
8,689,474 B2 * 4/2014 Garfinkle ..... G09F 7/10 40/611.05
8,827,739 B2 9/2014 Hanses
8,857,086 B2 10/2014 Adams et al.
9,058,752 B2 6/2015 Ganster et al.
2001/0039699 A1 11/2001 McAllister
2003/0068919 A1 * 4/2003 Martich ..... H01R 9/2683 439/488
2004/0068907 A1 * 4/2004 Bazany ..... B65D 25/205 40/642.02
2004/0098897 A1 5/2004 Thompson
2004/0178308 A1 9/2004 Bacnik
2005/0003700 A1 * 1/2005 Huang ..... H01R 13/465 439/491
2010/0095572 A1 * 4/2010 Laursen ..... H01R 13/518 40/661
2010/0221948 A1 * 9/2010 Truskett ..... C07C 51/00 439/491
2011/0005110 A1 1/2011 Wieneke
2011/0279841 A1 11/2011 Reibke
2015/0040447 A1 * 2/2015 Ganster ..... G09F 3/0295 40/647
2015/0068085 A1 3/2015 Reibke et al.

FOREIGN PATENT DOCUMENTS

DE 2307258 A1 1/1974
DE 8404741 U1 9/1985
DE 8503760 U1 6/1988
DE 19747663 A1 6/1998
DE 20303475 U1 5/2003
DE 202004009980 U1 11/2005
DE 202009003250 U1 7/2010
EP 0552413 B1 6/1996
EP 2214267 A1 8/2010
FR 2665044 A1 1/1992

(56) References Cited

FOREIGN PATENT DOCUMENTS

| | | | | |
|---|---|---|---|---|
| FR | 2849291 | A1 | 6/2004 | |
| GB | 1006915 | | 10/1965 | |
| WO | WO 0156911 | A1 * | 8/2001 | ..... B65C 9/1803 |
| WO | 2016037874 | A1 | 3/2016 | |

OTHER PUBLICATIONS

Phoenix Contact, KLM-1 Terminal Strip Markers, 3 pgs., Jan. 22, 2010.

Wireland Marking Tags, http://us1.activepoint.com/Newark_2011/print.html?uid+1332365588290, 1 pg., printed Mar. 21, 2012.

Weidmüeller Terminal Marker catalog pages, 18 pgs., date unknown.

* cited by examiner

TERMINAL BLOCK MARKER

CROSS REFERENCE TO RELATED APPLICATION

This application claims priority to U.S. Provisional Application Ser. No. 62/208,157, filed Aug. 21, 2015, the subject matter of which is hereby incorporated by reference in its entirety.

FIELD OF THE INVENTION

The present invention relates to a terminal block marker, and more particularly to a two piece snap in terminal block marker.

BACKGROUND OF THE INVENTION

Terminal blocks have been labeled via adhesive backed labels that are affixed to the front surface of terminal blocks for identification. However, the surface of terminal blocks are irregular and inconsistent from block to block resulting in poor adhesion of these labels that are vulnerable to unintentional removal by inadvertent physical contact or adhesive deterioration over time leaving the terminal blocks unidentifiable.

Another common method of identifying terminal blocks is via terminal block markers with mounting latches. The terminal block markers are formed from a semi-rigid molded plastic material, such as ABS. The mounting latches protrude from the back of the label surface. The mounting latches engage the opening in a terminal block to secure the terminal marker to the terminal block. The terminal markers are typically printed on demand using specialized printing systems designed specifically for terminal block markers or manufactured with pre-printed legends. These systems are unique from other printing operations and typically require specific software and operator training.

As a result, there exists a need for a terminal block marker having mounting latches and a label secured thereto, where the label is printed in a common roll fed thermal transfer printer using standard labeling software.

SUMMARY OF THE INVENTION

A terminal block marker with identification markings installed in a terminal block. The terminal block marker is used to identify the terminal block. The terminal blocker marker includes a rigid base and a flexible film insert. The rigid base includes a top with a first arm having a first inwardly extending projection and a second arm having a second inwardly extending projection. The rigid base also includes a bottom with legs extending in a direction opposite the arms to hold the terminal block marker in a terminal block. The flexible film insert includes identification markings and is installed on the rigid base. The flexible film insert is positioned under a first projection of the first arm and rotated downward until the flexible film insert snaps under the second projection of the second arm. The first and second projections retain the flexible film insert on the rigid base to form the terminal block marker.

DETAILED DESCRIPTION

Figure 1:
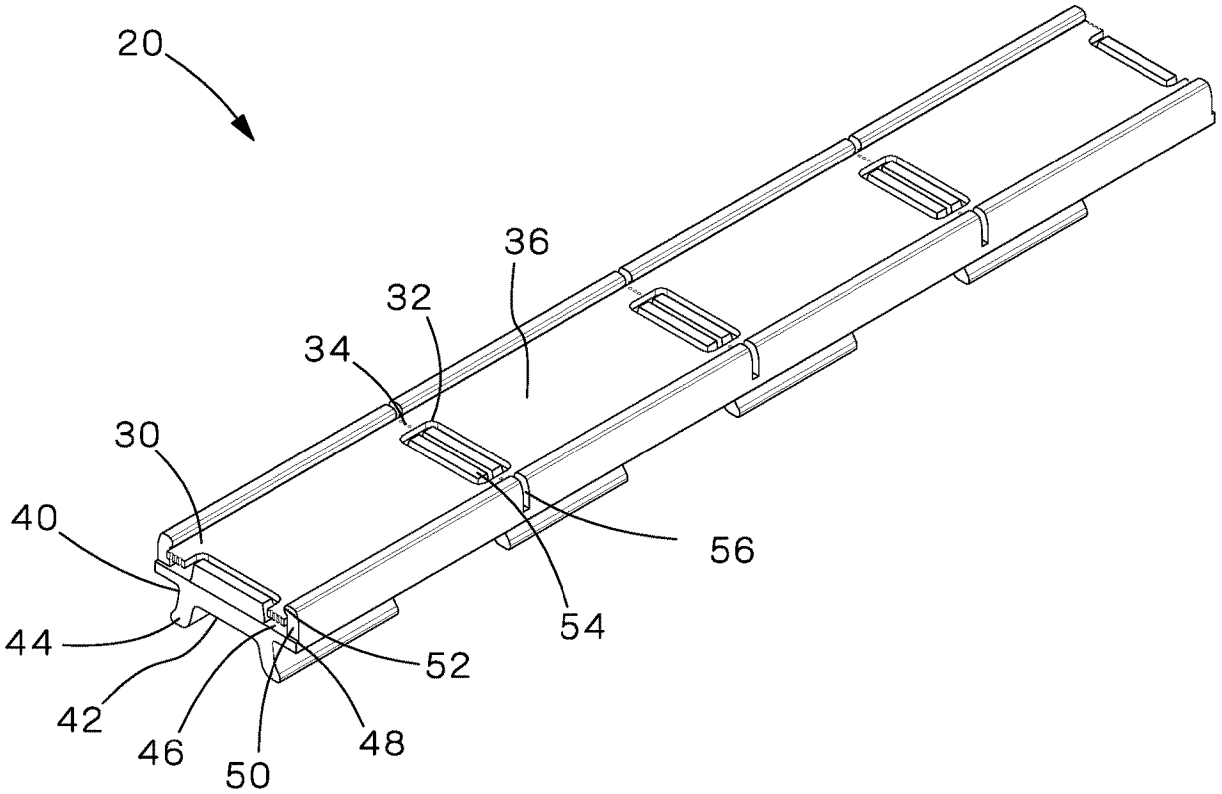
FIG. 1 is a perspective view of the terminal block marker of the present invention.

FIG. 1 illustrates a perspective view of the terminal block marker 20 of the present invention. The terminal block marker includes a flexible film insert 30 (See FIG. 2) and a rigid base 40 (see FIG. 3).

Figure 2:
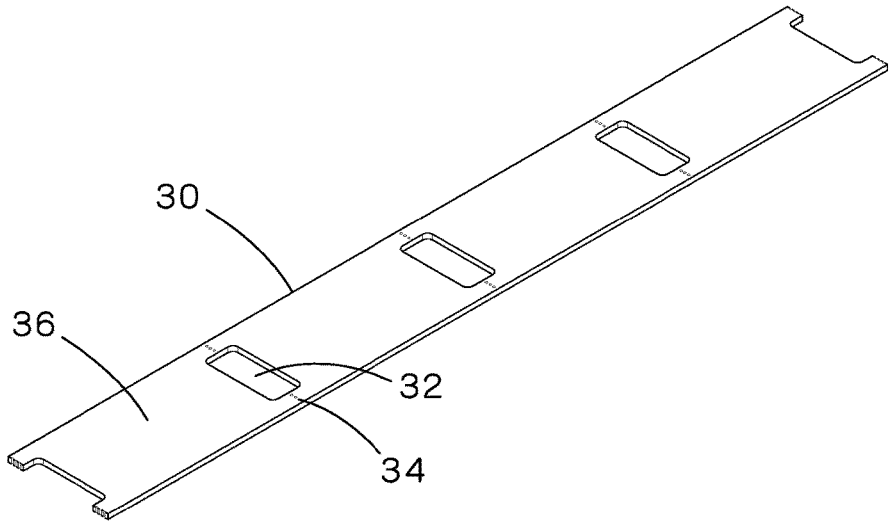
FIG. 2 is a perspective view of a film insert of the terminal block marker illustrated in FIG. 1.

As illustrated in FIG. 2, the flexible film insert 30 includes a plurality of rectangular slots 32 and perforations 34. The slots 32 and perforations 34 define the printable sections 36 of the film insert 30. The perforations 34 allow customers to tear off the appropriate number of printable sections 36 for a given labeling job. The slots 32 enable the printer to sense and correctly position the text on printable sections 36 of the film insert 30. As described below with respect to FIG. 8, the slots 32 also receive the positioning pads 54 of the base 40 when the film insert 30 is installed in the base 40.

The flexible film insert 30 is manufactured and supplied to customers in a roll form. The roll of film insert 30 may be installed in a standard thermal transfer printer for receiving the required identification markings.

Figure 3:
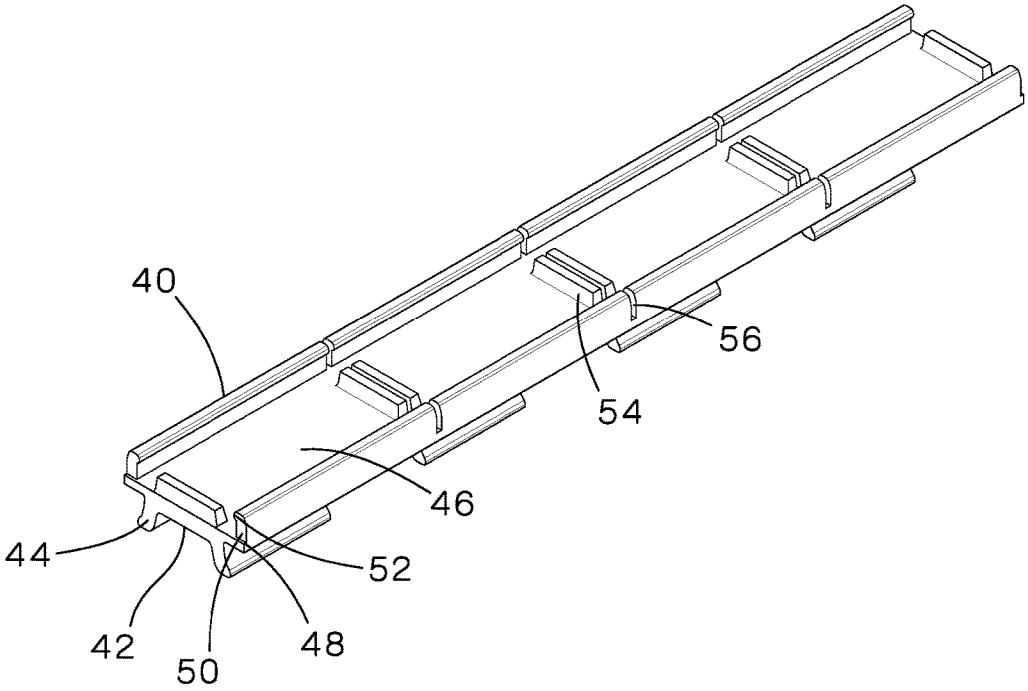
FIG. 3 is a perspective view of a base of the terminal block marker illustrated in FIG. 1.

As illustrated in FIG. 3, the base 40 includes a bottom 42 with two downwardly extending legs 44 and a top 46 with arms 50 positioned along the edges 48 extending in a direction opposite the legs 44. The legs 44 enable the base 40 to be installed in a terminal block 60 (see FIG. 9). Each arm 50 includes a projection or protrusion 52 that extends inwardly toward a center of the base 40. As a result, the arms 50 and the top 46 of the base form a U-shaped snap that enables the flexible film insert 30 to be installed and retained on the base 40. The base 40 also includes a plurality of rectangular positioning pads 54 for receiving the slots 32 of the film insert 30 and perforations 56. The perforations 56 enable the customer to tear off the appropriate number of bases 40 for the labeling job.

Figure 4:
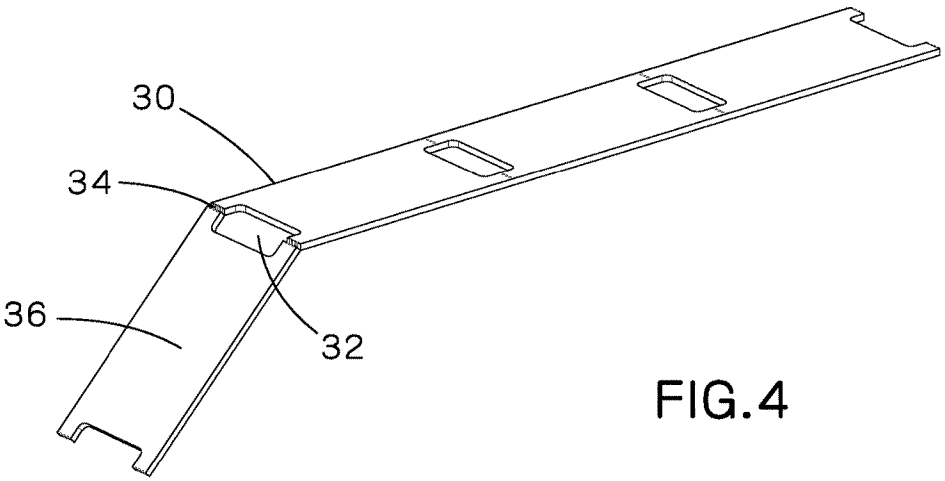
FIG. 4 is a perspective view of the film insert of FIG. 2 bent at a perforation.
Figure 5:
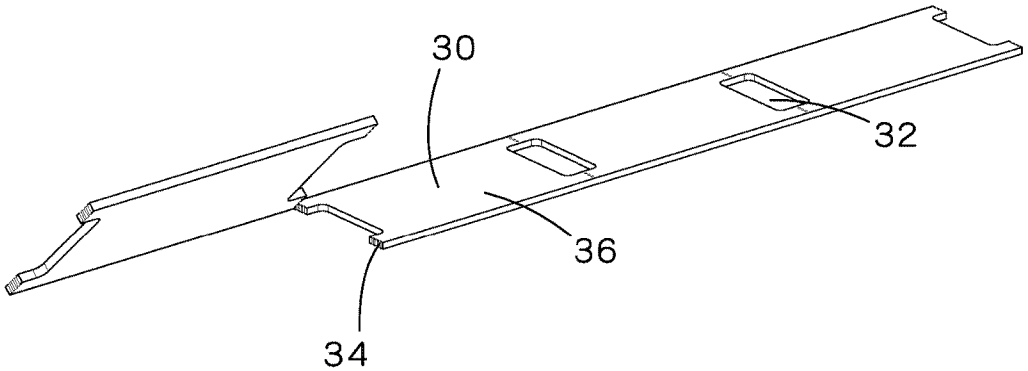
FIG. 5 is a perspective view of the film insert of FIG. 4 partially torn at the perforation.
Figure 6:
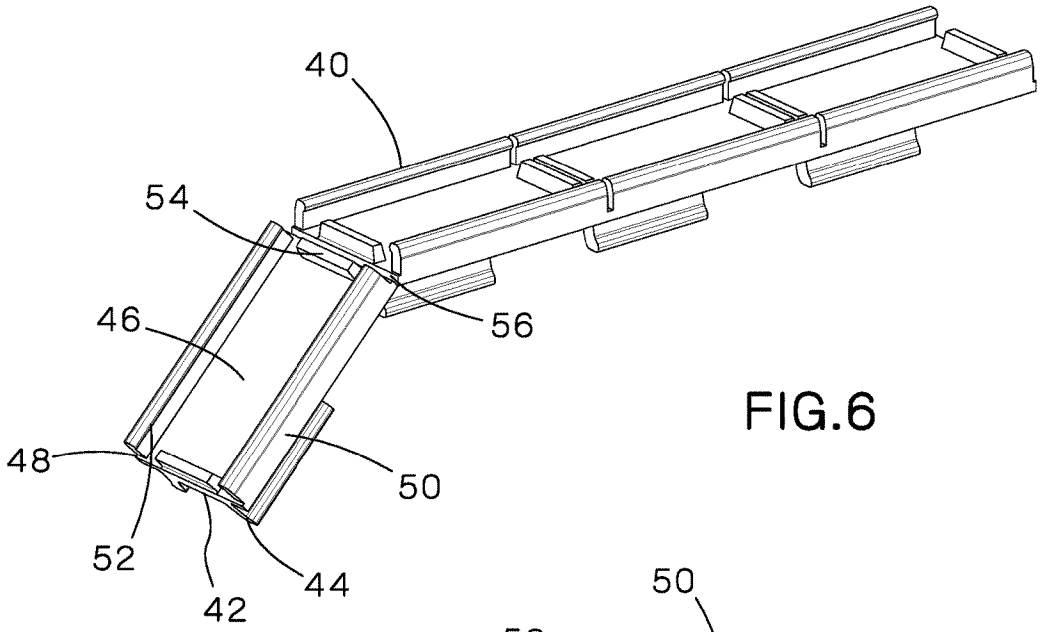
FIG. 6 is a perspective view of the base of FIG. 3 bent at a perforation.
Figure 7:
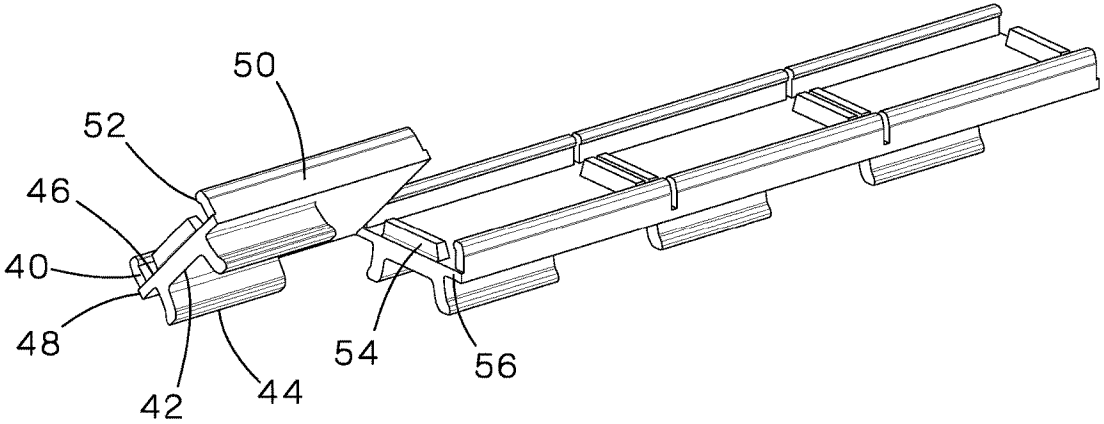
FIG. 7 is a perspective view of the base of FIG. 6 partially torn at the perforation.

FIGS. 4 and 5 illustrate the film insert 30 being bent at the perforation 34 and partially torn at the perforation 34, respectively. FIGS. 6 and 7 illustrate the base 40 being bent at the perforation 56 and partially torn at the perforation 56, respectively. Preferably, a customer completely tears off a printed film insert 30 and a base 40 at the desired length and then installs the printed film insert 30 into the base 40 to form the terminal block marker 20.

Figure 8:
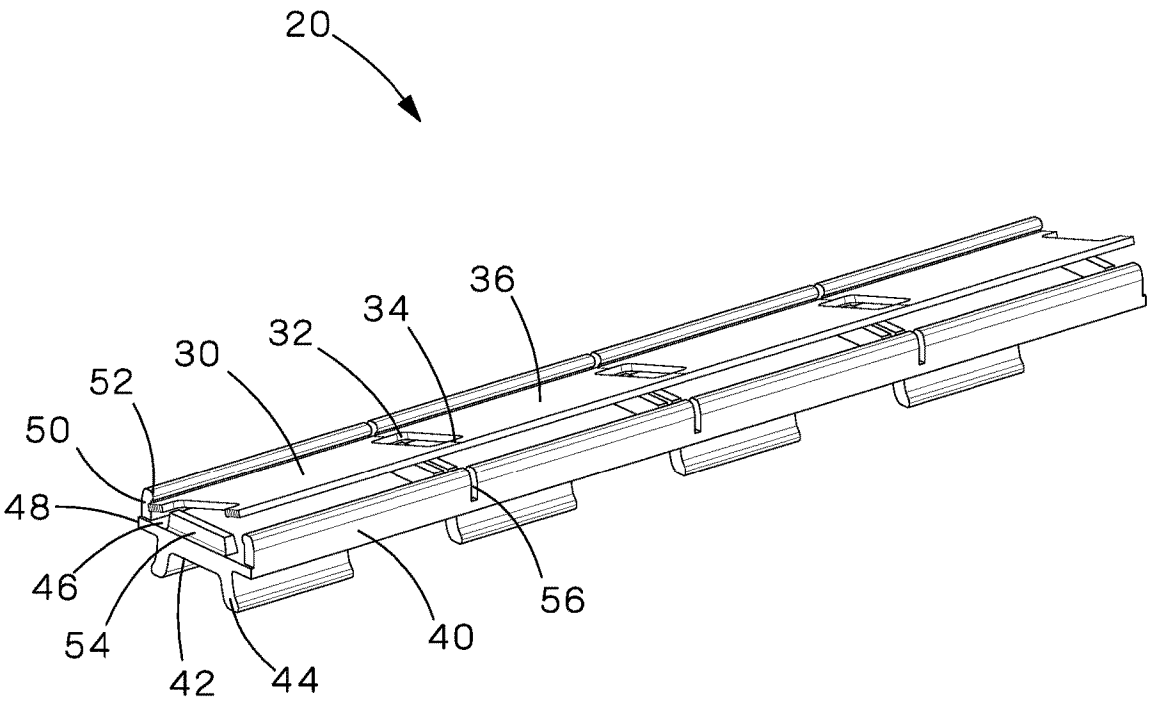
FIG. 8 is a perspective view of the film insert being installed in the base of the terminal block marker of FIG. 1.

FIG. 8 illustrates the film insert 30 being installed in the base 40. The film insert 30 is positioned under one of the projections 52 of an arm 50 that forms part of the U-shaped snap. The film insert 30 is rotated downward toward the base until the film insert 30 snaps under the projection 52 of the second arm 50 that forms the U-shaped snap. The projections 52 retain the film insert 30 on the base 40.

Figure 9:
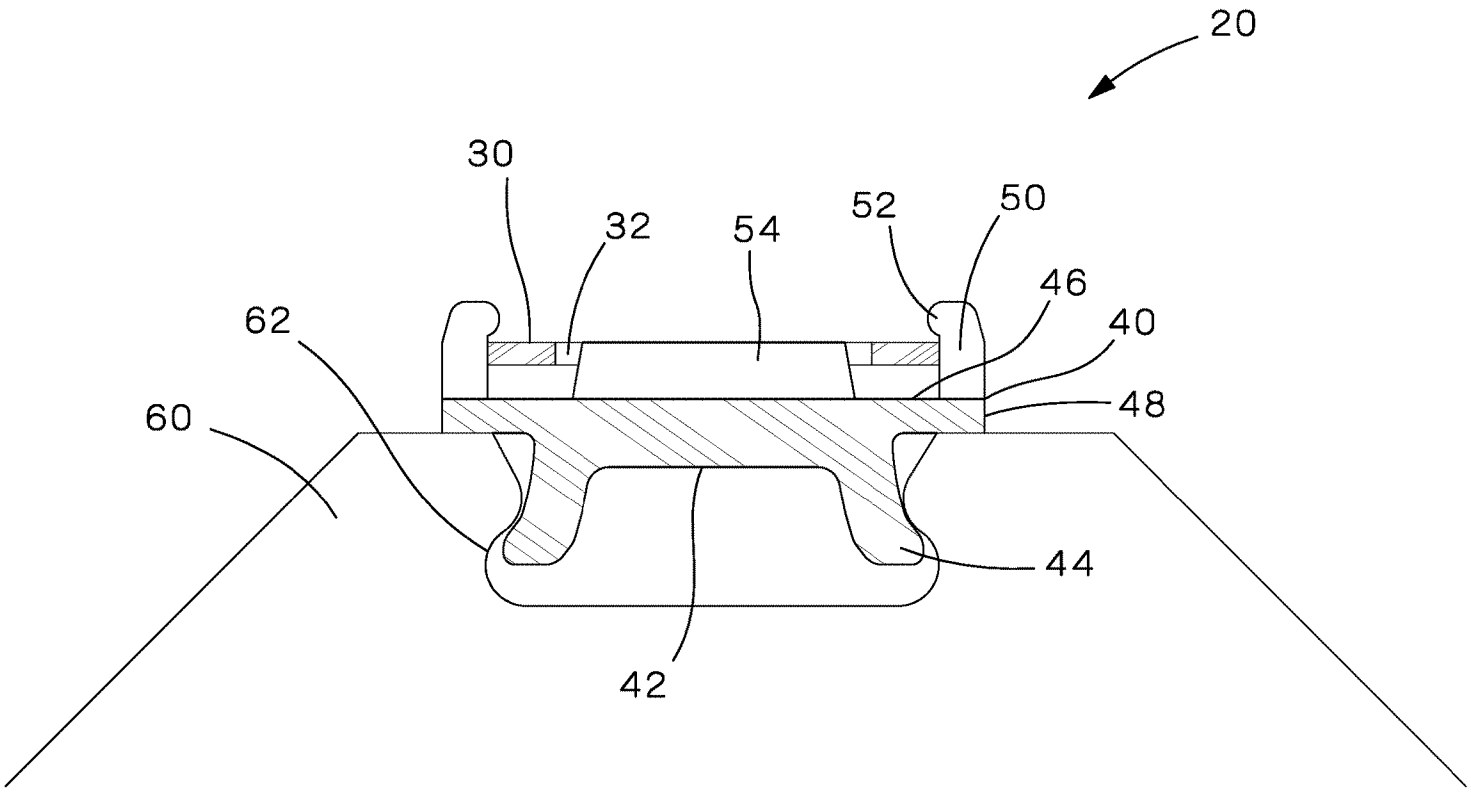
FIG. 9 is a front view of the terminal block marker of FIG. 1 installed in a terminal block.
Figure 10:
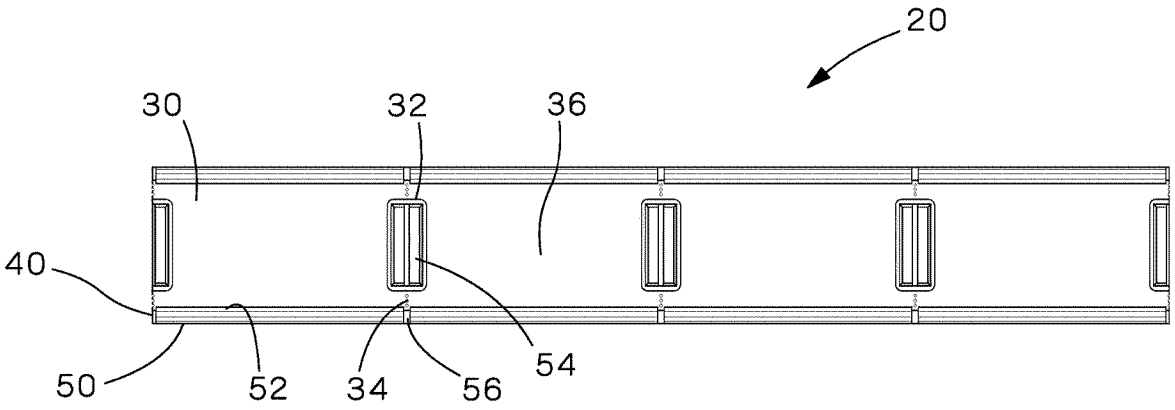
FIG. 10 is a top view of the terminal block marker of FIG. 1.
Figure 11:
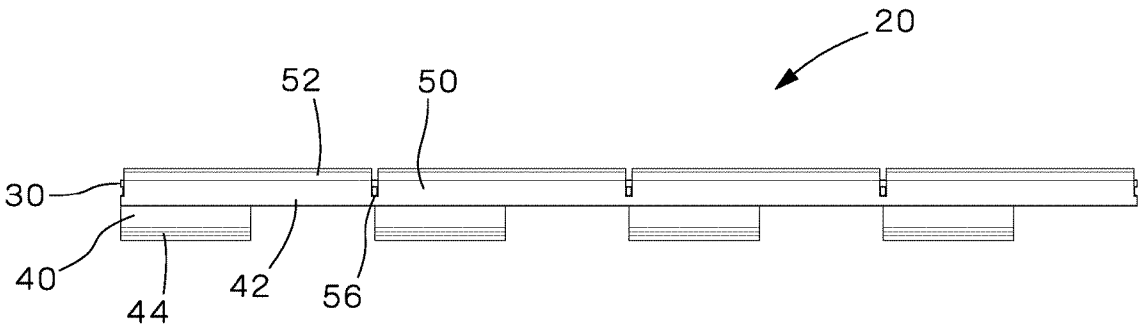
FIG. 11 is a side view of the terminal block marker of FIG. 1.
Figure 12:
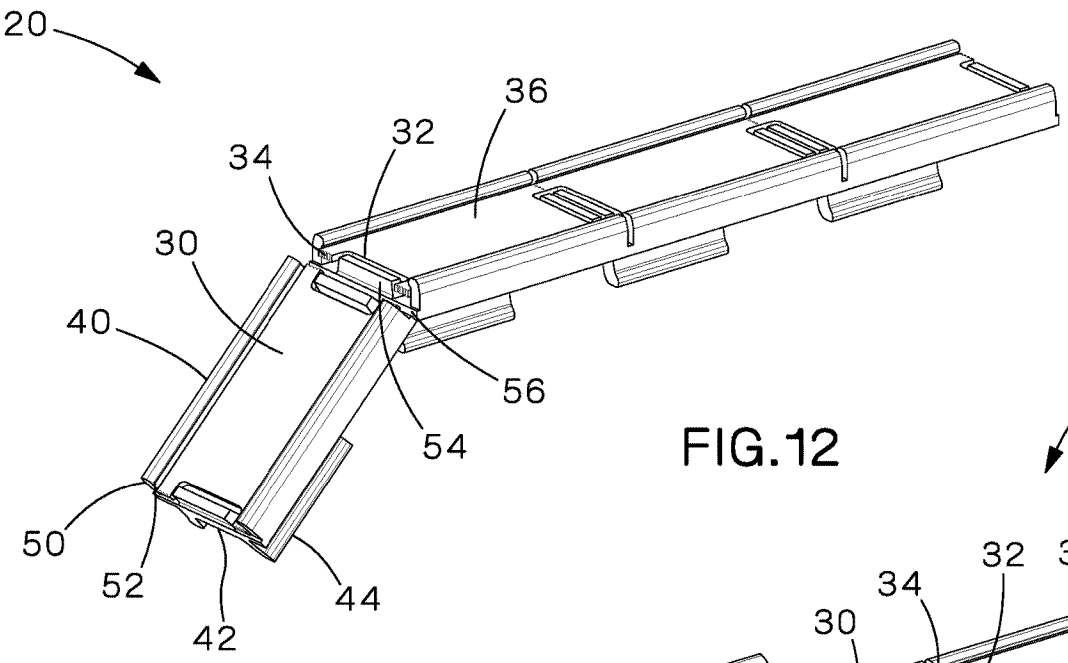
FIG. 12 is a perspective view of the terminal block marker of FIG. 1 bent at a perforation.
Figure 13:
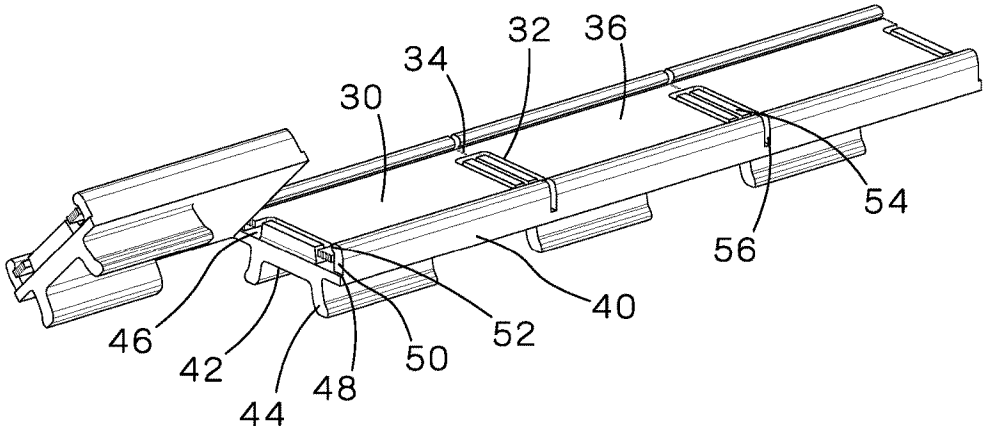
FIG. 13 is a perspective view of the terminal block marker of FIG. 12 partially torn at the perforation.

FIGS. 9-13 illustrate the flexible film insert 30 installed in the base 40 to form the terminal block marker 20 of the present invention. As illustrated in FIG. 9, when the terminal block marker 20 is installed into a terminal block 60, the legs 44 of the base 40 press against the walls 62 of the terminal block 60 providing a natural resistance to hold the terminal block marker 20 in place. As illustrated in FIGS. 9 and 10, when the film insert 30 is snapped into the base 40, the slots 32 of the film insert 30 receive the positioning pads 54 of the base 40 and the perforations 34 of the film insert 30 and the perforations 56 of the base 40 are aligned. The positioning pads 54 control the relative position of the film insert 30 and the text or legend printed thereon.

Alternatively, the customer may tear off the assembled terminal block marker 20 at the desired length. Similar to FIGS. 4-7, FIGS. 12 and 13 illustrate the assembled terminal block marker 20 bent at the aligned perforations 34, 56 and partially torn at the aligned perforations 34, 56.

The terminal block marker 20 of the present invention provides many benefits. First, the use of a flexible film insert 30 allows the customer to use their current thermal transfer printer with no modifications. The thermal transfer printer will use the slots 32 in the film insert 30 to sense and correctly position the text. Additionally, the flexible film insert 30 can be removed from the base 40 and replaced with a film insert 30 that contains an updated label. The perforations 34 in the film insert 30 and the perforations 56 in the base 40 enable the customer to easily break off the desired number of film inserts 30, bases 40, or assembled terminal block markers 20 that are necessary for labeling the terminal blocks.

Furthermore, while the particular preferred embodiments of the present invention have been shown and described, it will be obvious to those skilled in the art that changes and modifications may be made without departing from the teaching of the invention. The matter set forth in the foregoing description and accompanying drawings is offered by way of illustration only and not as limitation.

The invention claimed is:

1. A terminal block marker for identifying a terminal block, the terminal block marker comprising:

a rigid base adapted to be secured to the terminal block, the rigid base including a top with a first arm having a first inwardly extending projection and a second arm having a second inwardly extending projection, and a bottom with legs extending in a direction opposite the arms for holding the terminal block marker in the terminal block;

a flexible film insert installed on the rigid base, the flexible film insert being positioned under a first projection of the first arm and rotated downward until the flexible film insert snaps under the second projection of the second arm, wherein the first and second projections retain the flexible film insert on the rigid base;

wherein the flexible film insert having printable sections and slots for enabling a printer to sense each printable section on the flexible film insert;

wherein the rigid base having positioning pads, the positioning pads extending from the top of the rigid base, the rigid base having perforations located adjacent the positioning pads, the perforations enable a length of the rigid base to be torn;

wherein each slot of the flexible film insert receives at least one of the positioning pads when the flexible film insert is installed on the rigid base and the positioning pads extend above the installed flexible film insert to control the position of the flexible film insert; and wherein the flexible film insert having perforations, wherein the perforations in the flexible film insert are aligned with the perforations in the rigid base when the flexible film insert is installed on the base, whereby the aligned perforations enable a length of the assembled terminal block marker to be torn off.

2. The terminal block marker of claim 1, wherein the flexible film insert further comprising perforations located adjacent the slots, wherein the slots and the perforations define the printable sections of the flexible film insert, whereby the perforations enable a length of the flexible film insert to be torn.

3. The terminal block marker of claim 1, wherein the flexible film insert is provided in a roll form for enabling the flexible film insert to be installed in a printer to receive identification markings.

4. A terminal block marker for identifying a terminal block, the terminal block marker comprising:

a rigid base adapted to be secured to the terminal block, the rigid base including a top with a first arm having a first inwardly extending projection and a second arm having a second inwardly extending projection, and a bottom with legs extending in a direction opposite the arms for holding the terminal block marker in the terminal block; and a flexible film insert installed on the rigid base, the flexible film insert being configured to be positioned under the first projection of the first arm and rotated towards the top until the flexible film insert snaps under the second projection of the second arm, wherein the first and second projections retain the flexible film insert on the rigid base;

wherein the rigid base has perforations and the flexible film insert has perforations, wherein the perforations in the flexible film insert are aligned with the perforations in the rigid base when the flexible film insert is installed on the base, whereby the aligned perforations enable a length of the assembled terminal block marker to be torn off.

5. The terminal block marker of claim 4, wherein the flexible film insert further comprising printable sections and slots for enabling a printer to sense each printable section on the flexible film insert.

* * * * *